US007565976B2

(12) United States Patent
Nakamura et al.

(10) Patent No.: US 7,565,976 B2
(45) Date of Patent: Jul. 28, 2009

(54) WET SHEET PACKAGE

(76) Inventors: Kenji Nakamura, 3-41, Nishiawaji 6-chome, Higashi Yodogawa-ku, Osaka-shi, Osaka (JP); Koji Nakamura, 3-41, Nishiawaji 6-chome, Higashi Yodogawa-ku, Osaka-shi, Osaka (JP)

( * ) Notice: Subject to any disclaimer, the term of this patent is extended or adjusted under 35 U.S.C. 154(b) by 423 days.

(21) Appl. No.: 11/527,809

(22) Filed: Sep. 27, 2006

(65) Prior Publication Data

US 2007/0068838 A1 Mar. 29, 2007

(30) Foreign Application Priority Data

Sep. 29, 2005 (JP) ..... 2005-284985
Sep. 1, 2006 (JP) ..... 2006-237195

(51) Int. Cl.
*B65D 85/16* (2006.01)

(52) U.S. Cl. ..... 206/494; 206/233; 206/205; 206/210

(58) Field of Classification Search ..... 206/494, 206/210, 449, 497, 207, 205; 383/211, 66
See application file for complete search history.

(56) References Cited

U.S. PATENT DOCUMENTS

| | | | | |
|---|---|---|---|---|
| 4,197,949 | A * | 4/1980 | Carlsson | 229/229 |
| 4,458,810 | A * | 7/1984 | Mahoney | 206/210 |
| 4,552,269 | A * | 11/1985 | Chang | 383/211 |
| 4,570,820 | A * | 2/1986 | Murphy | 221/34 |
| 5,264,265 | A * | 11/1993 | Kaufmann | 428/42.1 |
| 6,026,953 | A * | 2/2000 | Nakamura et al. | 206/233 |
| 6,428,867 | B1 * | 8/2002 | Scott et al. | 428/40.1 |

FOREIGN PATENT DOCUMENTS

| | | |
|---|---|---|
| JP | S57-22041 | 2/1982 |
| JP | 58-88366 U | 6/1983 |
| JP | S58-171367 | 10/1983 |
| JP | H01-226579 | 9/1989 |
| JP | U 05-3173 | 1/1993 |
| JP | H07-041061 | 2/1995 |
| JP | 08-246395 | 9/1996 |
| JP | 2000-229681 | 8/2000 |
| JP | 2001-145517 | 5/2001 |
| JP | 2001-294254 | 10/2001 |
| JP | 2002-209788 | 7/2002 |
| JP | 2004-182253 | 7/2004 |
| JP | 2004-189262 | 7/2004 |
| JP | 2004-338803 | 12/2004 |
| JP | 2005-219773 | 8/2005 |

* cited by examiner

*Primary Examiner*—Jacob K Ackun, Jr.
*Assistant Examiner*—King M Chu
(74) *Attorney, Agent, or Firm*—Knobbe, Martens, Olson & Bear LLP

(57) ABSTRACT

A wet sheet package storing folded wet sheets includes a package container and an open/close flap provided in the top surface of the container. An output opening through which to take out the wet sheets is provided at the approximate center in the top surface of the container, the open/close flap has a separation stopping part formed on one end, as deemed appropriate, in order to seal the output opening, and the open/close flap opens and closes the output opening by acting, together with the separation part of the top surface, as an open/close lid of the package container. A liquid-absorbent sheet with a void space at its approximate center is securely attached to the top surface of the container, and the open/close flap is adherably arranged on the top surface of the liquid-absorbent sheet.

19 Claims, 4 Drawing Sheets

WET SHEET PACKAGE

BACKGROUND OF THE INVENTION

1. Field of the Invention

The present invention relates to a wet sheet package offering improved sealing property and stability of quality without reducing the adhesive strength of an open/close flap due to attachment of water or oil contained in the inside liquid charged into the wet sheet package, by securely attaching, around an output opening through which to take out wet sheets on the top surface of a container for storing wet sheets, a microporous liquid-absorbent sheet exhibiting water absorbency or oil absorbency to the top surface and making this liquid-absorbent sheet and the open/close flap adherable to each other.

2. Description of the Related Art

With respect to a package for a stack of folded wet tissues or non-woven fabric sheets impregnated with cosmetic material, structures in which the output opening of the wet tissues is provided with a sheet-shaped lid coated with pressure-sensitive adhesive have been known. For example, as disclosed in Japanese Patent Laid-open No. Sho 57-022041 (Patent Literature 1) and Japanese Patent Laid-open No. Sho 58-171367 (Patent Literature 2), configurations are known wherein a cut to allow for separation (half cut area) is provided in the top surface of a pillow package and then an open/close flap coated with pressure-sensitive adhesive is adherably arranged in a manner covering the output opening after the initial opening.

In addition, when the bulk of the package decreases as the content is consumed, the area around the output opening where pressure-sensitive adhesive is coated is wrinkled and the sealing performance drops as a result. It is known that there are technologies to improve the situation as in Japanese Patent Laid-open No. 2000-229681 (Patent Literature 3) wherein a package body having a clear polyester sheet provided between a sheet-shaped lid or an open/close flap and the package material as a reinforcing plate to keep the sealing property is disclosed.

There is also a problem of reduced sealing property of the sheet-shaped lid, which is caused by wetting of the area around the output opening where pressure-sensitive sensitive adhesive is coated by water or oil in the inside liquid impregnated into the non-fabric sheets, etc. To address this problem, methods have been proposed to make this area less likely to get wet by inserting an internal frame or tray and thereby providing a buffer space, as disclosed in Japanese Utility Model Laid-open No. Sho 58-088366 (Patent Literature 4), Japanese Patent Laid-open No. Hei 01-226579 (Patent Literature 5), and Japanese Patent Laid-open No. Hei 07-41061 (Patent Literature 6).

However, the above known technologies cannot fully prevent wetting of the area around the output opening, and if the area gets wet with water or oil the adhesive strength will almost completely disappear and the sealing property will drop. As mentioned above, insertion of an internal frame, tray, etc., is effective to some extent in the prevention of this area from getting wet, but such methods cannot fully prevent the liquid contained inside from leaking out onto the area around an output opening. Furthermore, such structures would make the package bulkier and it is inconvenient for the user to carry around.

Patent Literature 1: Japanese Patent Laid-open No. Sho 57-022041

Patent Literature 2: Japanese Patent Laid-open No. Sho 58-171367

Patent Literature 3: Japanese Patent Laid-open No. 2000-229681

Patent Literature 4: Japanese Utility Model Laid-open No. Sho 58-088366

Patent Literature 5: Japanese Patent Laid-open No. Hei 01-226579

Patent Literature 6: Japanese Patent Laid-open No. Hei 07-41061

SUMMARY OF THE INVENTION

As explained above, the open/close flap functioning as a lid of a wet sheet package has a problem of losing its adhesive strength as a result of forming a liquid layer film on the pressure-sensitive adhesion surface due to water and oil in the inside liquid when pressure-sensitive adhesive gets wet by taking out wet sheets soaked with the impregnation liquid repeatedly.

For this reason, the bag causes sealing problem only after several times of use because of insufficient adhesion of the open/close lid. This in turn causes the wet sheets to become dry by exposing to air, and negatively affects the stability of quality. Accordingly, there has been a strong need to improve the adhesive strength of the open/close flap in order that the flap can withstand repeated adhesions.

The present invention is to improve sealing property of the package where substantial drop of the adhesive strength of pressure-sensitive adhesive occurs, improve durability, and realize a wet tissue package having improved stability of quality by means of providing a structure that does not produce a liquid layer film even when the pressure-sensitive adhesion surface gets wet as sheets are taken out repeatedly, regardless of whether the sheets are impregnated with water-based liquid or oil-based liquid.

In other words, the present invention basically has one or more of the following configurations (in this disclosure, the word "the present invention" simply means an embodiment of the present invention):

1) A wet sheet package comprising (A) a package container for storing folded wet sheets and (B) an open/close flap provided in the top surface of the container, wherein an output opening through which to take out the wet sheets is provided at the approximate center in the top surface the container, (C) the open/close flap has a separation stopping part formed on one end, as deemed appropriate, in order to seal the output opening, and (D) the open/close flap opens and closes the output opening by acting, together with the separation part of the top surface, as an open/close lid of the package container; the wet sheet package characterized in that (1) a liquid-absorbent sheet with a void space at its approximate center is securely attached to the top surface of the container, and (2) the open/close flap is adherably arranged on the top surface of the liquid-absorbent sheet.

2) A wet sheet package according to (1), characterized in that, due to the existence of the liquid-absorbent sheet, the part that is adherable maintains the inside of the container in a sealed condition without being affected by moisture absorption or oil absorption.

3) A wet sheet package according to (1) or (2), characterized in that the package container is a pillow package having in its top surface an output opening.

4) A wet sheet package according to (1) through (3), characterized in that the package container is a box-shaped container made of plastic, paper, wood or metal and having in its top surface an output opening.

5) A wet sheet package according to any one of (1) through (4), characterized in that the void space at the approximate center of the liquid-absorbent sheet is formed by a cutout hole, and the internal dimensions of the hole are equal to or slightly larger than the wet-sheet output opening.

6) A wet sheet package according to any one of (1) through (5), characterized in that the liquid-absorbent sheet is a water-absorbent or oil-absorbent sheet and is selected from among fine microporous synthetic resin film, non-woven fabric, woven fabric, textile, paper, grain-planted sheet, and flocked sheet.

7) A wet sheet package according to any one of (1) through (5), characterized in that a liquid-absorbent impressed part is provided in place of the liquid-absorbent sheet.

DESCRIPTION OF THE SYMBOLS

Figure 1:
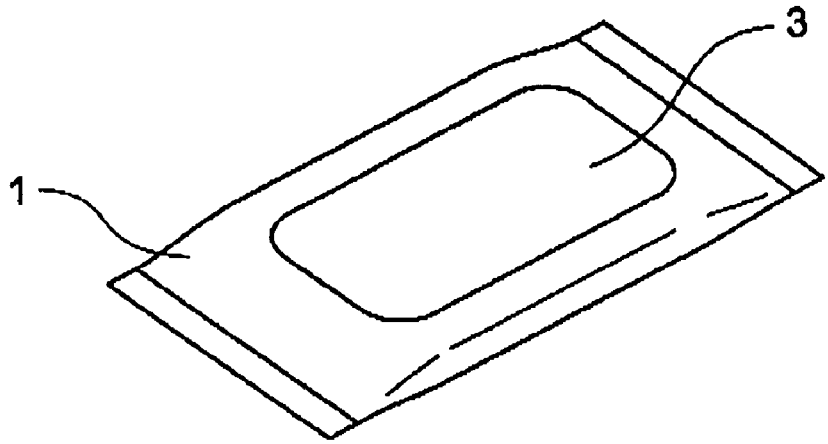
FIG. 1 is a perspective view of a package conforming to the present invention.

1 Top surface of container
1' Separation part on top surface (area defined by a half-cut line)
2 Liquid-absorbent sheet
2' Void space
3 Open/close flap
4 Pressure-sensitive adhesive
5 Adhesive
6 Half-cut line in top surface
7 Cutout line for liquid-absorbent sheet 2
8 Top surface
10 Part that is adherable
11 Output opening for taking out wet sheets
12 Flap separation stopping part
13 Cutout hole in liquid-absorbent sheet

DETAILED DESCRIPTION OF THE PREFERRED EMBODIMENT

The wet sheet package proposed by the present invention may use a bag body formed by pillow packaging or a container made of plastic, paper or other relatively hard material.

Of the two, the bag body formed by the pillow packaging method is produced through a heat-sealing process performed on a pillow package machine and therefore uses flexible sheet film laminated with heat sealant.

As to the film, there are laminated films such as PET/PE, OPP/PE, PET/AL/PE, etc., where polyethylene is used as heat sealant and it is preferable that a material used has vapor barrier property, oxygen barrier property, oil resistance and/or light shielding property against impregnation liquid or medical fluids such as the liquid inside the package.

It has been known that the output opening in the top surface of the pillow package container is formed by a half-cut line separable in a closed-loop or open-loop pattern, so that when the package is opened, the half-cut area is separated and used as the output opening through which to take out wet sheets, while allowing the open/close flap provided in the top surface to be used as the open/close lid. The present invention is characterized in that, among others, a liquid-absorbent sheet is securely attached to the top surface near the output opening and the liquid-absorbent sheet and open/close flap are adherable to each other.

The shape of the output opening may be oval or round or have any other appropriate shape, and the shape of the open/close flap can be changed in accordance with the shape of the output opening.

On the other hand, a container made of plastic, paper, wood, metal or any other relatively hard material may have a box shape having an output opening in its top surface. In this case, a liquid-absorbent sheet exhibiting water absorbency or oil absorbency is securely attached to the top surface of the container near the wet-sheet output opening, as in the case of a pillow package.

According to the present invention, the liquid-absorbent sheet is disposed between the top surface of the container and the open/close flap. Here, the top surface and liquid-absorbent sheet must be securely attached to each other. Since the liquid-absorbent sheet and open/close flap are adherably attached by means of pressure-sensitive adhesive, liquid film will not form on the adhesion surface due to the liquid absorbency of the liquid-absorbent sheet, even if water or oil leaking from the inside of the container attaches to the adhesion part of the liquid-absorbent sheet. As a result, adhesive strength will not drop and degradation of wet sheets inside the container can be prevented.

The liquid-absorbent sheet used in the present invention is fine microporous synthetic resin material having a water absorbency or oil absorbency and selected from film, non-woven fabric, woven fabric, textile, paper, or a grain-planted sheet or flocked sheet. This does not limit the selection of the synthetic resin but any synthetic resin that has water absorbency or oil absorbency function by capillary action may be used.

Microporous film (product manufactured by Sumitomo 3M Limited; material: polyolefin), easy open film (product manufactured by Asahi Kasei Corporation; material: PET), polytetrafluoroethylene film (product manufactured by Nihon Millipore K.K.), polyurethane wet foam sheet, microfilter film or any other material having the same effects as the foregoing may used as suitable material for the liquid-absorbent sheet. A porous film made of polyolefin or fluorine synthetic resin having continuous micropores of 0.1 to 10 μm in size show an excellent effect.

In addition to the film materials listed above, material grafted with acrylic acid to improve water absorbency, material to which water absorbency has been added via Permalose™ treatment, or porous cellulose or PVA film, can also be used.

Non-woven fabric or woven fabric used as the liquid-absorbent sheet should preferably be made of fine fibers and have fine irregularities on the sheet surface to trap liquid.

If paper is used, synthetic paper or cosmetic oil-blotting paper with fine irregularities embossed on its surface is preferred.

In grain plantation and flocking, kaolin, silicon dioxide, silicon anhydride, aluminum magnesium silicate, sericite, talc, hemp powder, cotton powder, biocellulose powder, silk powder, acrylic bead, polyurethane bead or glass bead with a grain size of 5 μm or less can be used.

If a grain-planted sheet is used, it is desirable to coat adhesive on the sheet surface and then attach grains to the adhesive-coated surface by means of electrostatic flocking. It is also possible to provide hot-melt treatment on the sealant surface of PET/PE or other heat-sealed film and then plant grains on the hot-melt surface using the electrostatic flocking method.

As to a wet sheet, non-woven fabric as a base material impregnated with the inside liquid is suitable. If the impregnation weight ratio against the base material is approximately 150% or less, inner diameter of the liquid-absorbent sheet may be the same length as the output opening because the contact surface of the package top surface and open/close flap does not get wet much. However, if the impregnation weight ratio against the base material becomes 150% or more, inner diameter of the liquid-absorbent sheet is preferably 1 mm-5 mm larger than the output opening length for having a buffer area since leakage of the inside liquid increases from area around the output opening.

On the other hand, the dimension of the liquid-absorbent sheet may be the same as, smaller than, or larger than the dimension of the open/close flap. Alternatively, it may also be the size that covers the entire top surface of the container.

Similar effects can also be demonstrated by providing an impressed part made of liquid-absorbent material, instead of using a liquid-absorbent sheet.

Providing a liquid-absorbent impressed part means adding water absorbency or oil absorbency by printing, impressing or transferring fine grains. Fine grain used for this purpose may be kaolin, silicon dioxide, silicon anhydride, aluminum magnesium silicate, sericite, talc, hemp powder, cotton powder, biocellulose powder, silk powder, acrylic bead, polyurethane bead or glass bead. The size of this fine grain should be 5 μm or less, or preferably 3 μm or less. Even if the aforementioned impressed part gets wet by liquid, the liquid will permeate through the void space between fine grains and the head of each fine grain will still exhibit adhesive property. For this reason, lower adhesive strength or loss of stickiness will not occur as a result of wetting. Adding fine scratches to the base material of the impressed part by means of brushing, etc., can effectively improve the liquid absorption effect.

When providing an impressed part, adding fine scratches to the film surface by means of brushing, etc., and then applying acrylic acid grafting to improve water absorbency; applying Permalose™ treatment to add water absorbency; or laminating porous cellulose or PVA film, is effective in ensuring the adherability of the open/close flap. However, the above methods are not economical, because the intended effect is required only in the adhesion part. Impressing film is a rational way, as it can add liquid absorbency only to the necessary part through the impression process.

The impressed part offering liquid absorbency may have an oval shape with a punched hole at the center, or a donut shape, just like the shape of the liquid-absorbent sheet as mentioned above. If the impressed part has a donut shape, its inner diameter may be the same as the output opening, but it is desirable to provide a buffer area by setting the inner diameter of the donut shape 1 to 5 mm larger than the output opening, because if the edge of the impressed part gets wet, permeation will easily expand. The external dimensions of the liquid-absorbent impressed part may be the same as or slightly smaller than the external dimensions of the open/close flap. If the external dimensions of the impressed part are larger than the external dimensions of the open/close flap, there are no specific limitations on the dimensions.

According to the present invention, the liquid-absorbent sheet is disposed between the top surface of the container and the open/close flap, where the top surface and liquid-absorbent sheet are completely and securely attached to each other, while the liquid-absorbent sheet and open/close flap are adherably attached by means of pressure-sensitive adhesive. Therefore, liquid film will not form on the adhesion surface due to the liquid absorbency of the liquid-absorbent sheet, even if water or oil leaking from the inside of the container attaches to the adhesion part. As a result, adhesive strength will not drop.

Also, the wet tissue container proposed by the present invention has a structure whereby liquid layer film will not form even if the pressure-sensitive adhesive surface gets wet as a result of repeated removals of wet sheets, regardless of whether the liquid impregnated in the sheets is water-based or oil-based. This improves the sealing property of the container, which will otherwise drop due to reduced adhesive strength of pressure-sensitive adhesive, and thereby improves durability and stability of quality.

How the package proposed by the present invention can be opened and closed using the open/close flap is explained by referring to the drawings.

Figure 2:
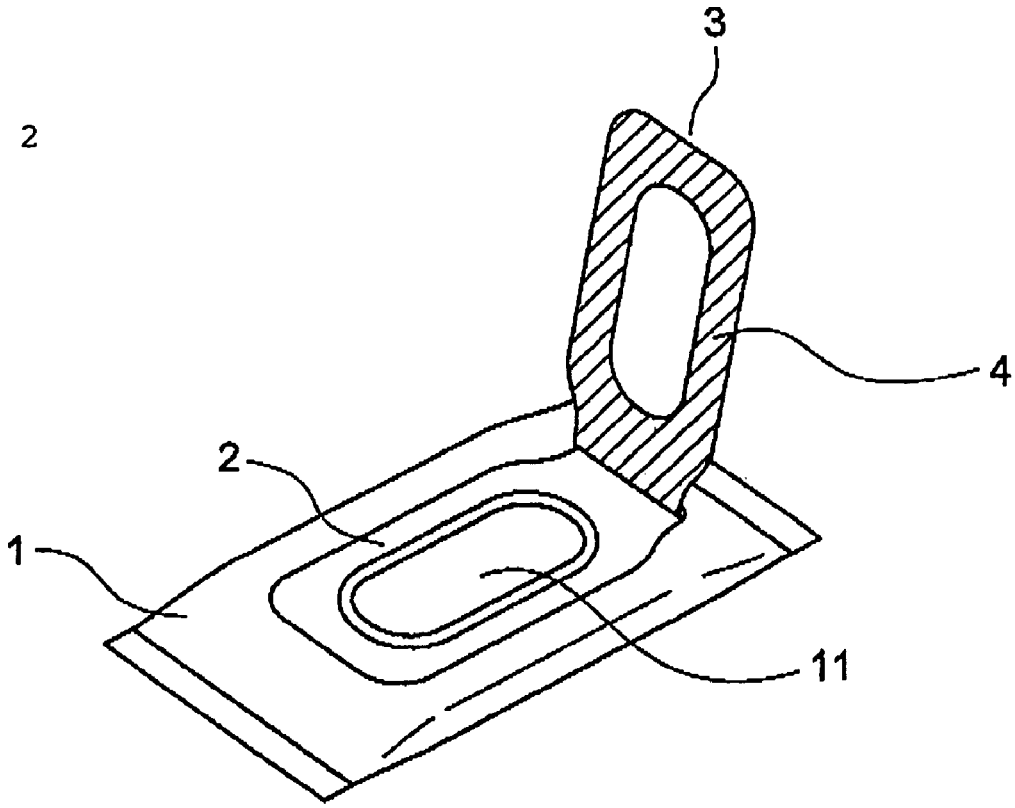
FIG. 2 is a drawing showing an open state of a package conforming to the present invention is open.
Figure 3:
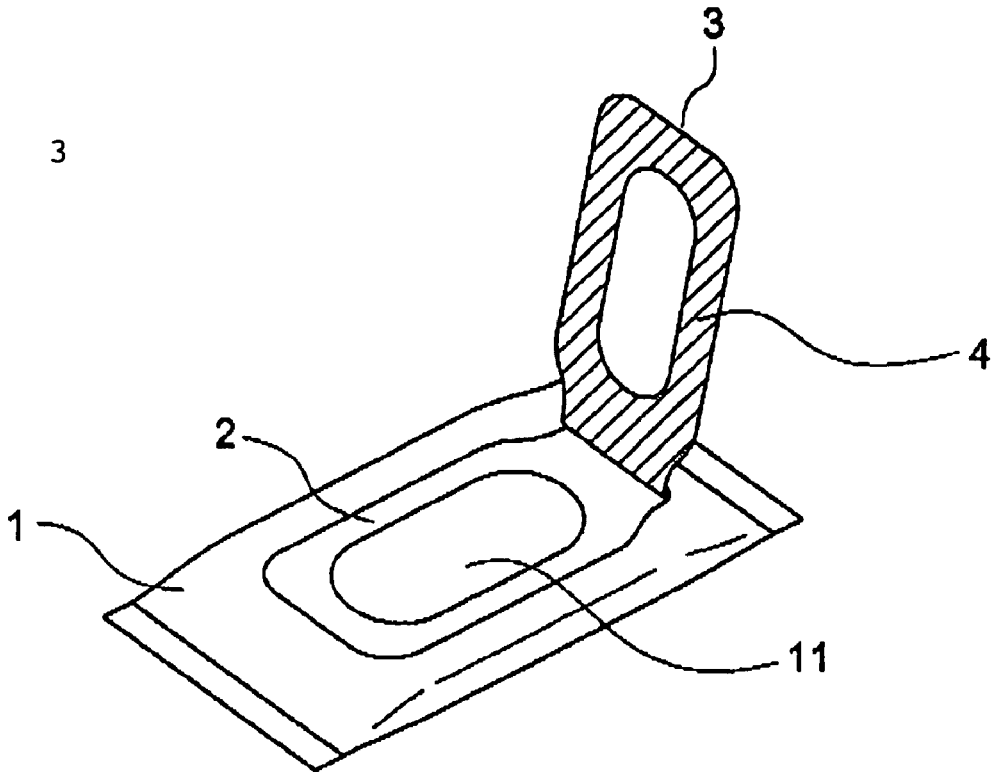
FIG. 3 is a drawing showing an open state of a package conforming to the present invention is open (example of variation).
Figure 4:
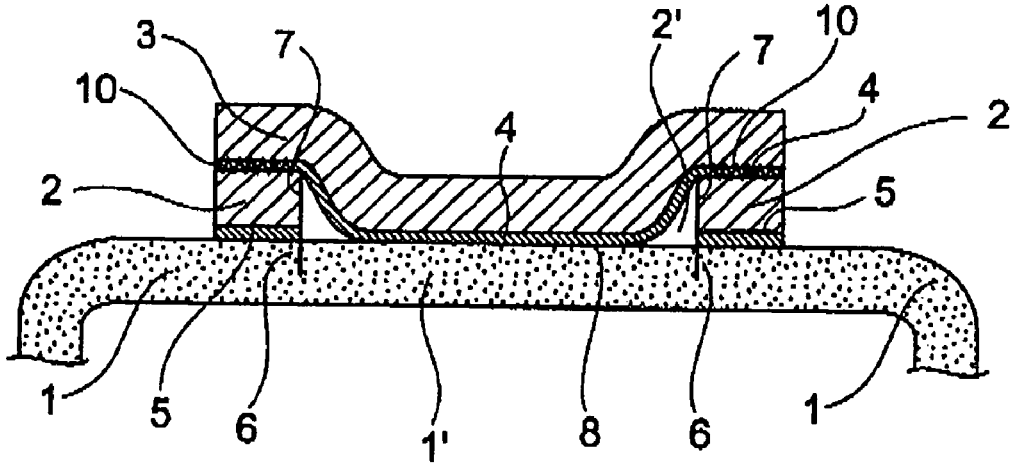
FIG. 4 is a cross-section view of the top surface of a package conforming to the present invention.
Figure 5:
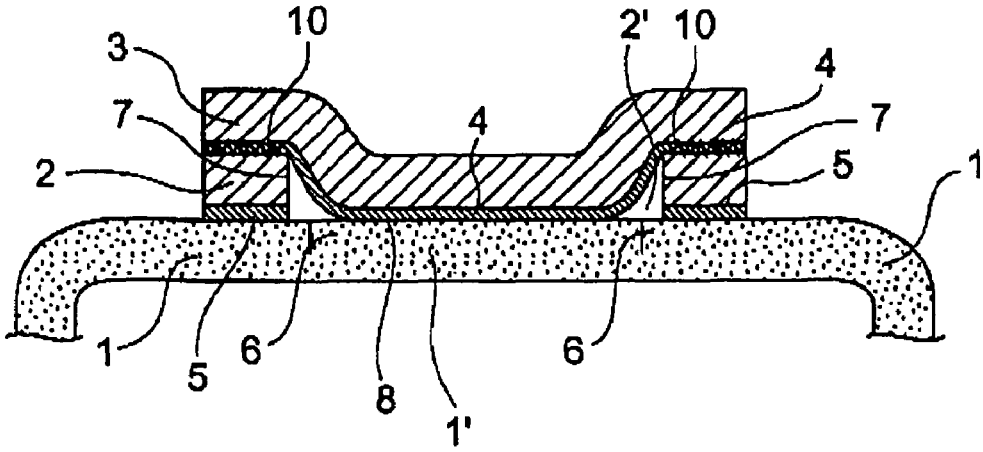
FIG. 5 is an example of variation of FIG. 4.
Figure 6:
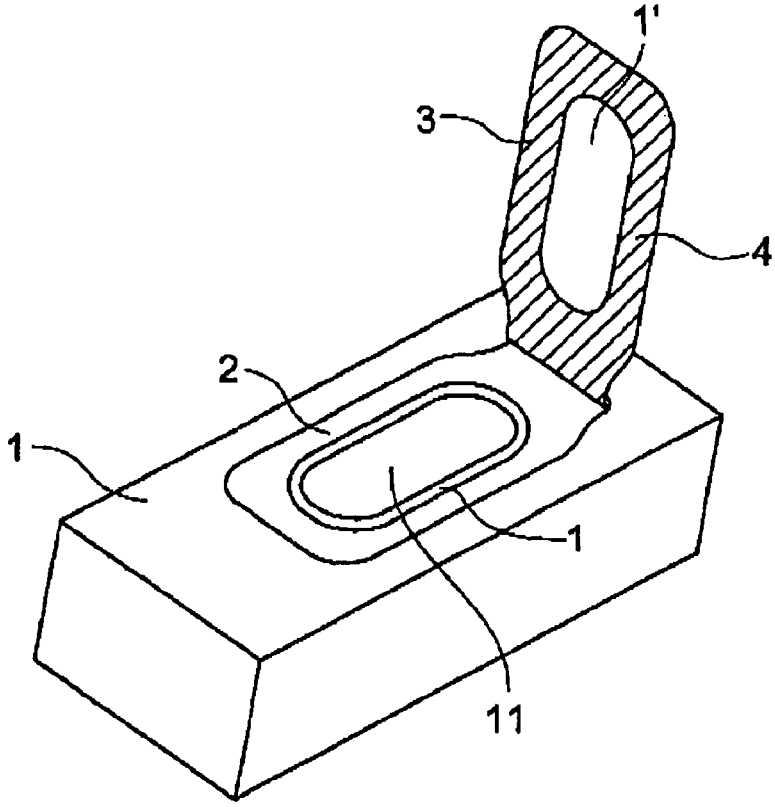
FIG. 6 is a perspective view of a package conforming to the present invention provided as a box-shaped container.
Figure 7:
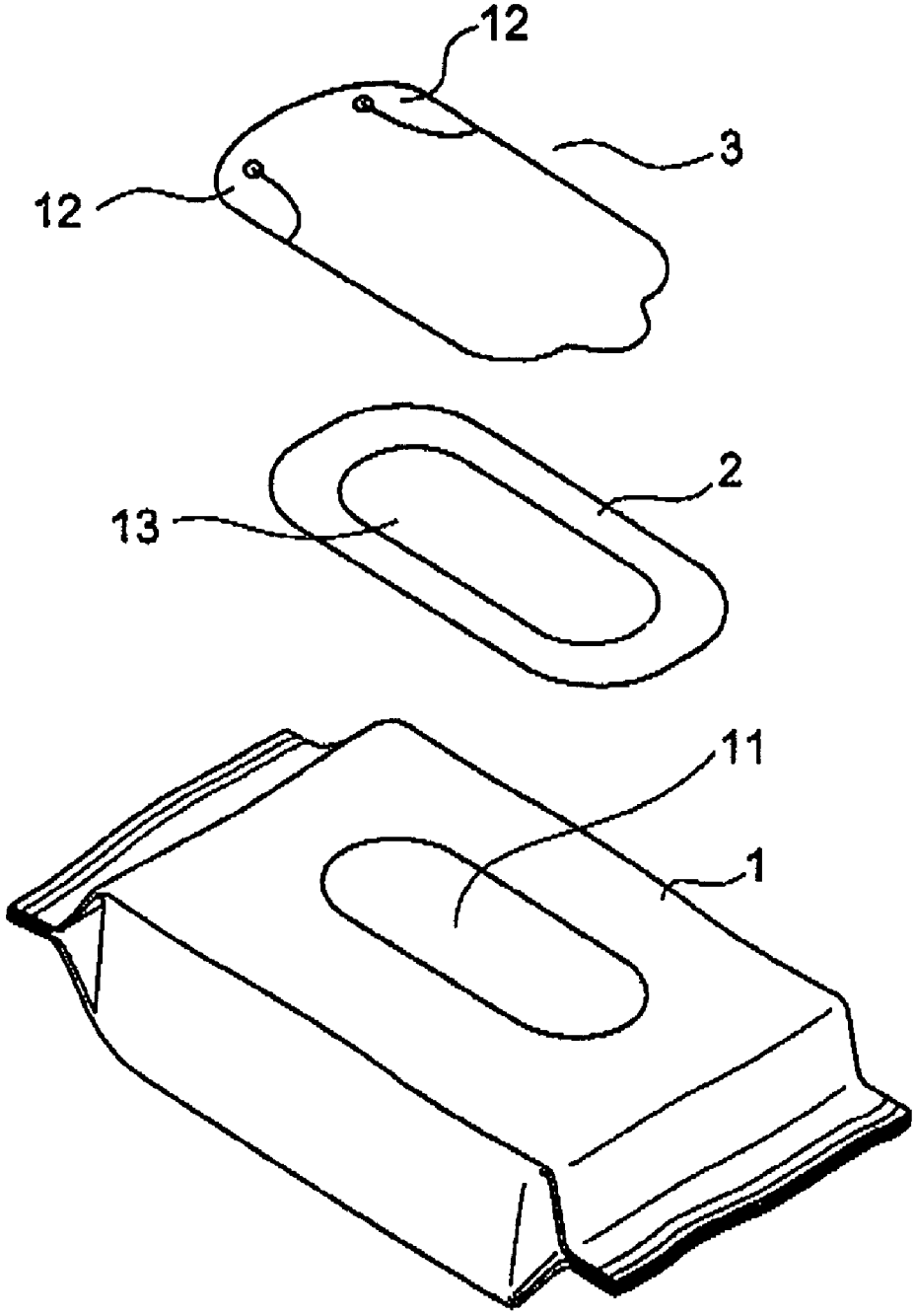
FIG. 7 is an exploded perspective view showing the top surface of the container, liquid-absorbent sheet and open/close flap.

FIG. 1 is a perspective view of a container 1 conforming to the present invention. FIG. 2 shows an open state of a container conforming to the present invention, with its open/close flap lifted up. FIG. 3 also shows an open state of a container with its open/close flap lifted (example of variation of FIG. 2). FIG. 4 is a cross-section view of the top surface of a container 1 shown in FIG. 2, before it is opened. FIG. 5 is an example of variation of FIG. 4. FIG. 6 is a perspective view of an open box-shaped container made of plastic, paper or other relatively hard material. FIG. 7 is an exploded perspective view showing the top surface, open/close flap and liquid-absorbent sheet constituting a box-shaped container per the present invention made of hard material.

The cross section of the top surface of a container 1 conforming to the present invention as shown in FIG. 1 comprises the structure shown in FIG. 4 wherein a liquid-absorbent sheet 2 and an open/close flap 3 are arranged on the top surface of the container.

Also, pressure-sensitive adhesive 4 is applied to the side of the open/close flap 3 contacting the container, and this surface also has a stamped remainder that has been left after stamping the microporous liquid-absorbent sheet 2 having a shape roughly corresponding to the outer diameter of the open/close flap 3 (a donut-shaped part having a stamped hole of round, oval or appropriate rectangular shape) and the open/close flap 3.

One end of the open/close flap 3 shown in FIGS. 1 through 3 may have a separation stopping part 12 that prevents the entire flap from separating when the open/close flap is lifted up, as shown in FIG. 7, or may not have such part.

FIGS. 4 and 5 show cross sections of a pillow package container having an open/close flap in its top surface (condition before use). In FIG. 4, a cut line 7 of the liquid-absorbent sheet is provided roughly along the same line as a half-cut line 6 provided for separation in the top surface of the container. In FIG. 5, the half-cut line 6 is provided inside the cut line 7 and the area between these two lines serves as a buffer area to prevent the inside liquid from leaking out.

Before use (before the container is first opened), the open/close flap 3 is adhered to a top surface 8 of the container 3 by means of pressure-sensitive adhesive via a void space 2' in the liquid-absorbent sheet 2, as shown in FIG. 6. When the open/close flap 3 is lifted up with a strong force to open the container, a separation part 1' in the top surface, initially adhered to the flap, is also torn to form an output opening 11 through which to take out wet tissues in the container. After the first use, the open/close flap 3 and separation part 1' will work together to function as the lid of the output opening 11.

The open/close flap 3 may have a separation stopping part 12 formed on one end, as shown in FIG. 7, or may not have such part.

The liquid-absorbent sheet 2 is formed preferably by microporous material, and has a hole 13 stamped in it whose shape roughly corresponds to the shape of the output opening 11. The numeral 7 indicates the cut line for this cutout hole. The liquid-absorbent sheet 2 having this stamped hole 13 of an appropriate shape is adhered to near the outer periphery of the output opening 11, which has been separated from the top surface of the container 1, by means of powerful adhesive 5.

The liquid-absorbent sheet 2 is also securely attached to the top surface of the container 1 by means of adhesive 5, and the opposite surface (top side in the figure) is adherably attached to the open/close flap 3 by means of pressure-sensitive adhesive 4 in accordance with the opening/closing of the lid.

Similar effects can also be demonstrated by providing a water-absorbent or oil-absorbent impressed part by means of printing, impression or transfer, instead of using a liquid-absorbent sheet.

As explained above, after the second opening of the lid the open/close flap 3 and the separation part 1' in the top surface of the container work together as they are adhered together, while an area 10 of the open/close flap where pressure-sensitive adhesive is applied is adherable to the liquid-absorbent sheet 2. Due to the existence of the liquid-absorbent sheet 2, even if the pressure-sensitive adhesive layer 10 gets wet by leaking water-based or oil-based liquid impregnated in the wet sheets, or water-based or oil-based liquid in the container, pressure-sensitive adhesive 4 will prevent liquid film from being formed on the surface. Therefore, the adhesive strength of pressure-sensitive adhesive 4 will not drop significantly and the sealing property of the lid of the output opening can be maintained.

If a box-shaped container is used, the container comprises the top surface 1 of the box, open/close flap 3, and liquid-absorbent sheet 2, as shown by the exploded perspective view in FIG. 7. As in the case of a pillow package, the liquid-absorbent sheet 2 is disposed in between. As a result, adhesion of the open/close flap will not be affected even if the area around the output opening gets wet.

In FIG. 7, a part of the open/close flap is adhered to the top surface. Even if the open/close flap is designed so that it can be completely separated from the hard container, however, similar effects can still be demonstrated as long as the liquid-absorbent sheet is adhered to the top surface of the container.

EXAMPLE

A bag 1 made of laminated film comprising PP/1L/PE was provided with an oval half cut of 50 mm in long diameter and 32 mm in short diameter at the center of the bag body. The center of a sheet-shaped lid of 85 mm in length and 50 mm in width, made of a microporous liquid-absorbent sheet 2, was then provided with an oval cut of 56 mm in long diameter and 38 mm in short diameter at the center of the sheet-shaped lid, and the lid was adhered onto the top part of the top surface separation part using acrylic adhesive. An area of 3 mm in width, designed to prevent permeation of impregnated liquid, was provided between the oval top side separation part of the bag body 1 and the cut of the porous liquid-absorbent plastic sheet 2. Next, on the porous liquid-absorbent plastic sheet 2, an open/close flap 3 wherein a polyester sheet of the same shape and size was coated with acrylic pressure-sensitive adhesive was placed to constitute a sheet-shaped lid.

Example 1

A microporous film was used for the liquid-absorbent sheet.

Different inside liquids were prepared as specified below (water-based liquid 1, water-based liquid 2, oil-based liquid 1, and oil-based liquid 2), and the peel strength (a width of 50 mm, unit: Newton) and strength retention ratio of the open/close flap after 30 minutes were measured using samples whose output opening was wetted with 1 mL of each liquid as well as samples whose output opening was not wetted.

The inside liquids used in the wet test were prepared as follows:

(A) Water-based liquid 1: Purified water (B) Water-based liquid 2: O/W-type water-based liquid for cleansing (80% purified water, 6% 1.3-BG, 6% PG, 7% ethanol, 1% non-ionic surface active agent)

(C) Oil-based liquid 1: Squalane (D) Oil-based liquid 2: W/O-type oil-based liquid containing squalane (20% liquid paraffin, 10% squalane, 7% PG, 1% non-ionic surface active agent, 62% purified water)

Example 2

An easy open film was used for the liquid-absorbent sheet.

Example 3

A wet polyurethane foam sheet was used for the liquid-absorbent sheet.

Example 4

Oil-blotting paper was used for the liquid-absorbent sheet.

Example 5

A PE sheet with grain-planted silicon dioxide was used for the liquid-absorbent sheet.

Example 6

A PE sheet grain-planted with hemp powder and polyurethane bead was used for the liquid-absorbent sheet.

Example 7

Table 3 shows the peel strength of the flap over a width of 50 mm (unit: Newton) in two conditions: when the pressure-sensitive adhesion area of the packaging film where silicon dioxide of 3 μm is printed in a donut shape is not wet, and 30 minutes after wetting the flap with 1 mL of the liquid. The strength retention ratios of wetted samples are also shown.

Example 8

Packaging film on which hemp powder of 2 μm was printed in a donut shape

[Comparison Test]

Packaging film having no printing of the present invention (untreated)

Using a container made with a PE liquid-absorbent sheet grain-planted with polyurethane bead and hemp powder (container conforming to the present invention) and a container not having a liquid-absorbent sheet (comparative example), the peel strength (over a width of 50 mm, unit: Newton) and strength retention ratio of the open/close flap after 30 minutes were measured on samples whose output opening was wetted with 1 mL of each liquid (water-based liquid 1, water-based liquid 2, oil-based liquid 1, and oil-based liquid 2) as well as samples whose output opening was not wetted.

The results are shown under [Table 1], [Table 2] and [Table 3].

TABLE 1

(Unit: Newton)

| | Water-based liquid 1 | | Water-based liquid 2 | | Oil-based liquid 1 | | Oil-based liquid 2 | |
|---|---|---|---|---|---|---|---|---|
| | Not wet | Wet | Not wet | Wet | Not wet | Wet | Not wet | Wet |
| Example 1 | 10.3 | 6.7 | 10.3 | 6.5 | 10.2 | 7.8 | 10.3 | 8.2 |
| | — | 65% | — | 63% | — | 75% | — | 79% |
| Example 2 | 8.2 | 6.0 | 8.2 | 5.9 | 8.2 | 5.0 | 8.2 | 5.1 |
| | — | 73% | — | 71% | — | 60% | — | 62% |
| Example 3 | 8.5 | 6.9 | 8.5 | 6.7 | 8.5 | 4.0 | 8.5 | 4.2 |
| | — | 81% | — | 79% | — | 47% | — | 49% |
| Comparative example | 7.8 | 0.2 | 7.8 | 0.2 | 7.8 | 0.1 | 7.8 | 1.0 |
| | — | 2% | — | 2% | — | 1% | — | 1% |

Note:
1. The unit is Newton.
2. % is strength retention ratio.

TABLE 2

| | Water-based liquid 1 | | Oil-based liquid 2 | |
|---|---|---|---|---|
| | Not wet | Wet | Not wet | Wet |
| Example 4 | 8.9 | 6.7 | 9.3 | 8 |
| | — | 75% | — | 86% |
| Example 5 | 8.3 | 6.8 | 8.1 | 5.7 |
| | — | 81% | — | 70% |
| Example 6 | 8.4 | 6.5 | 8.4 | 5.2 |
| | — | 77% | — | 61% |

TABLE 3

| | Water-based liquid 1 | | Oil-based liquid 1 | |
|---|---|---|---|---|
| | Not wet | Wet | Not wet | Wet |
| Example 7 | 8.5 | 6.5 | 8.8 | 6.6 |
| | — | 76% | — | 75% |
| Example 8 | 8.1 | 6.2 | 8.3 | 5.7 |
| | — | 76% | — | 68% |

(Evaluation of Results)

The samples obtained by Example 1, when wetted with oil-based liquids, maintained 75 to 79% of the pressure-sensitive adhesive force on non-wet samples. The retention ratios were 63 to 65% on samples wetted with water-based liquids. The samples obtained by Example 2, when wetted with oil-based liquids, maintained 60 to 62% of the pressure-sensitive adhesive force on non-wet samples. The retention ratios were 71 to 73% on samples wetted with water-based liquids.

The samples obtained by Example 3, when wetted with oil-based liquids, maintained 47 to 49% of the pressure-sensitive adhesive force on non-wet samples, which is slightly lower. However, the retention ratios were higher, between 79 and 81%, on samples wetted with water-based liquids.

The samples obtained by Example 4 exhibited high retention ratios of 86% on samples wetted with oil-based liquids, and 75% on samples wetted with water-based liquids, compared to non-wet samples. The samples obtained by Example 5 also exhibited high retention ratios of 70% on samples wetted with oil-based liquids, and 81% on samples wetted with water-based liquids, compared to non-wet samples. As for the samples obtained by Example 6, the retention ratios of pressure-sensitive adhesive force on samples wetted with oil-liquids and water-based liquids were 61% and 77%, respectively, compared to non-wet samples.

Also, the samples having an impressed part obtained by Examples 7 and 8 exhibited roughly the same levels of performance against wetting by both oil-based liquids and water-based liquids, as the samples having a liquid-absorbent sheet obtained by Examples 1 through 6.

On the other hand, the samples obtained by Comparative Examples retained only 2% of the adhesive strength on non-wet samples when wetted by water-based liquids, and only 1% of the adhesive strength on non-wet samples when wetted by oil-based liquids. The results confirm that these samples cannot provide desired sealing property.

The present application claims priority to Japanese Patent Application No. 2005-284985, filed Sep. 29, 2005 and No. 2006-237195, filed Sep. 1, 2006, the disclosure of which is incorporated herein by reference in their entirety.

What is claimed is:

1. A wet sheet package which comprises a package container for storing folded wet sheets and an open/close flap provided in the top surface of the container, wherein an output opening through which to take out the wet sheets is provided at the approximate center in the top surface of the container, the open/close flap has a separation part and a separation stopping part formed on one end which is a fixed, unopened end, as deemed appropriate, in order to seal the output opening, and the open/close flap opens and closes the output opening by acting, together with the separation part, as an open/close lid of the package container; said wet sheet package characterized in that a liquid-absorbent sheet with a void space at its approximate center corresponding to the output opening is securely attached to the top surface of the container as a first layer, and the open/close flap is separably attached to the top surface of the liquid-absorbent sheet as a second layer before first use of the open/close flap.

2. A wet sheet package according to claim 1, characterized in that, due to the existence of the liquid-absorbent sheet, the part that is adherable maintains the inside of the container in a sealed condition without being affected by moisture absorption or oil absorption.

3. A wet sheet package according to claim 1 or 2, characterized in that the package container is a pillow package having in its top surface a wet-sheet output opening.

4. A wet sheet package according to claim 1, characterized in that the package container is a box-shaped container made of plastic, paper, wood or metal and having in its top surface a wet-sheet output opening.

5. A wet sheet package according to claim 1, characterized in that the void space at the approximate center of the liquid-absorbent sheet is formed by a cutout hole, and the internal dimensions of the hole are equal to or slightly larger than the wet-sheet output opening.

6. A wet sheet package according to claim 1, characterized in that the liquid-absorbent sheet is a water-absorbent or oil-absorbent sheet and is selected from among fine microporous synthetic resin film, non-woven fabric, woven fabric, textile, paper, grain-planted sheet, and flocked sheet.

7. The wet sheet package according to claim 1, wherein the open/close flap has an outer peripheral shape and a size substantially corresponding to an outer peripheral shape and a size of the liquid-absorbent sheet.

8. The wet sheet package according to claim 7, wherein the liquid-absorbent sheet is donut-shaped, oval or rectangular shaped.

9. The wet sheet package according to claim 1, wherein the liquid-absorbent sheet and the open/close flap are re-sealable multiple times after water or oil leaks from the inside of the container through the output opening.

10. The wet sheet package according to claim 1, wherein the open/close flap is non-separably attached to the top surface of the container through the void space of the liquid-absorbent sheet before first use of the open/close flap.

11. A wet sheet package comprising:

a package container for storing folded wet sheets, wherein an output opening for taking out the wet sheets therethrough is provided substantially or nearly at a center in a top surface of the container;

a liquid-absorbent portion having an opening substantially or nearly at its center, which is fixed to the top surface of the container at a position where the wet sheets can be taken out through the output opening of the container and the opening of the liquid-absorbent portion; and an open/close flap for opening and closing the output opening and the opening of the liquid-absorbent portion, wherein the open/close flap is separably attached to a top surface of the liquid-absorbent portion used as an underlying layer before first use of the open/close flap, wherein the open/close flap has a separation stopping part on one end and a separation part which is separated from the top surface of the liquid-absorbent portion.

12. The wet sheet package according to claim 11, wherein the liquid-absorbent portion is a water-absorbent and/or oil-absorbent sheet.

13. The wet sheet package according to claim 12, wherein the liquid-absorbent sheet is a water-absorbent or oil-absorbent sheet selected from the group consisting of fine microporous synthetic resin film, non-woven fabric, woven fabric, textile, paper, grain-planted sheet, and flocked sheet.

14. The wet sheet package according to claim 11, wherein the liquid-absorbent portion is a liquid-absorbent impressed part.

15. The wet sheet package according to claim 11, wherein the liquid-absorbent portion is constituted by a liquid-absorbent material printed on the top surface of the container.

16. The wet sheet package according to claim 11, wherein the open/close flap has an outer peripheral shape and a size substantially corresponding to an outer peripheral shape and a size of the liquid-absorbent portion.

17. The wet sheet package according to claim 16, wherein the liquid-absorbent portion is donut-shaped, oval or rectangular shaped.

18. The wet sheet package according to claim 11, wherein the liquid-absorbent portion and the open/close flap are re-sealable multiple times after water or oil leaks from the inside of the container through the output opening.

19. The wet sheet package according to claim 11, wherein the open/close flap is non-separably attached to the top surface of the container through the void space of the liquid-absorbent portion before first use of the open/close flap.

* * * * *